US012004607B2

(12) United States Patent
Singleton

(10) Patent No.: US 12,004,607 B2
(45) Date of Patent: Jun. 11, 2024

(54) MAGNETIC PIN ATTACHMENT DEVICE

(71) Applicant: Aubrey Singleton, Owen Sound (CA)

(72) Inventor: Aubrey Singleton, Owen Sound (CA)

( * ) Notice: Subject to any disclaimer, the term of this patent is extended or adjusted under 35 U.S.C. 154(b) by 0 days.

(21) Appl. No.: 17/804,154

(22) Filed: May 26, 2022

(65) Prior Publication Data

US 2023/0380553 A1 Nov. 30, 2023

(51) Int. Cl.
*A44C 1/00* (2006.01)
*A44C 7/00* (2006.01)

(52) U.S. Cl.
CPC ..... *A44C 1/00* (2013.01); *A44D 2203/00* (2013.01)

(58) Field of Classification Search
CPC ..... A44C 1/00; A44C 7/003; A44D 2203/00
USPC ..... 40/600, 661.01, 711; 428/900
See application file for complete search history.

(56) References Cited

U.S. PATENT DOCUMENTS 9,795,193 B2 * 10/2017 Fujita ..... A41F 1/002
10,595,619 B2 * 3/2020 Cureington ..... A45F 5/02
10,918,176 B1 * 2/2021 Roth ..... A44C 25/00
2004/0231212 A1 * 11/2004 Roche ..... B32B 5/02 40/600
2008/0005873 A1 * 1/2008 Barton ..... B43M 15/00 24/303
2008/0028580 A1 * 2/2008 Tanio ..... A44C 7/003 24/705

FOREIGN PATENT DOCUMENTS

EP 2687117 A2 * 1/2014 ..... A44B 1/34
WO WO-2010032707 A1 * 3/2010 ..... A44B 1/34

* cited by examiner

*Primary Examiner* — Jack W Lavinder
(74) *Attorney, Agent, or Firm* — Orin Del Vecchio

(57) ABSTRACT

A pin attachment device configured to be operably coupled to a decorative pin wherein the present invention provides the ability to display the decorative pin on a first material and a second material. The present invention includes a body wherein the body includes a lower portion and an upper portion. The lower portion and upper portion are contiguously formed. An aperture is present in the upper surface of the upper portion and provides access to a pin stud receiving passage. A locking member is operably coupled to the lower portion of the body distal to the upper portion. The locking member includes a lower surface wherein the lower surface has a cavity formed therein. The cavity is circumferentially surrounded by a perimeter wall. The perimeter wall assists in maintaining a securing member secured in the cavity. In a preferred embodiment the securing member is a magnet.

6 Claims, 2 Drawing Sheets

MAGNETIC PIN ATTACHMENT DEVICE

FIELD OF THE INVENTION

The present invention relates generally to ornamental apparatus, more specifically but not by way of limitation, a pin backing that is configured to secure a decorative pin to clothing or similar support surface wherein the present invention further includes the ability to releasably secure to a magnetic surface for display of a decorative pin when not in use on clothing.

BACKGROUND

As is known in the art, decorative pins, broaches and similar items are worn routinely by both men and women. These pins are provided in many shapes and sizes and can further be provided for both decorative or alternate reasons. Some pins can be quite ornate with precious gemstones while other pins are utilized for marketing purposes so as to draw attention to a cause or promote a business. Traditionally these pins are either worn on lapels of clothing or can be secured to alternate locations of clothing. While the pins vary widely, the backing mechanism for the pin is fairly consistent. Conventional technology deploys a backing that includes an aperture in a body wherein the aperture provides access to a hollow channel. The body of the conventional backing further includes a movable mechanism that is operable to engage a portion of the pin stud that has been disposed within the aperture/hollow channel. The movable mechanism releasably secures the pin stud so as to hold the decorative pin in place on the clothing.

One issue the conventional pin backing for the decorative pins is the inability to retain the decorative pins and display on alternate surfaces. The conventional pin backing functions to hold on clothing or other material wherein the pin stud can be penetrated therethrough and the pin backing receives and retains the pin stud. Many individuals prefer to be able to display their decorative pins when not being worn. As the decorative pins have a pin stud, this requires a corkboard or similar material to display the decorative pins. Corkboards are not desirable in many locations of an individuals home and as such the individual may not be able to display the decorative pin.

It is intended within the scope of the present invention to provide a decorative pin backing that is configured to facilitate securing of a decorative pin to clothing and further provide the ability to secure a pin to a magnetic surface in order to provide display thereof when not being worn on clothing.

SUMMARY OF THE INVENTION

It is the object of the present invention to provide a decorative pin backing configured to receive a pin stud of a decorative pin wherein the present invention includes a body having a lower portion and an upper portion.

Another object of the present invention is to provide a pin backing that is configured to releasably secure a pin stud therein and provide mounting to a first material and a second material wherein the lower portion and upper portion of the body are contiguously formed.

A further object of the present invention is to provide a decorative pin backing configured to receive a pin stud of a decorative pin wherein the body includes an aperture formed in the upper surface of the upper portion of the body.

Still another object of the present invention is to provide a pin backing that is configured to releasably secure a pin stud therein and provide mounting to a first material and a second material wherein the aperture provides access to a pin receiving passage formed in the center of the body.

An additional object of the present invention is to provide a decorative pin backing configured to receive a pin stud of a decorative pin wherein the present invention includes a movable locking member operably coupled to the lower portion of the body.

Yet a further object of the present invention is to provide a pin backing that is configured to releasably secure a pin stud therein and provide mounting to a first material and a second material wherein the movable locking member is planar in manner and annular in shape.

Another object of the present invention is to provide a decorative pin backing configured to receive a pin stud of a decorative pin wherein the movable locking member includes a cavity formed in the lower surface thereof.

An alternate object of the present invention is to provide a pin backing that is configured to releasably secure a pin stud therein and provide mounting to a first material and a second material wherein the cavity is circumferentially surrounded by a perimeter wall member.

Still a further object of the present invention is to provide a decorative pin backing configured to receive a pin stud of a decorative pin wherein cavity has secured therein a magnet member.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
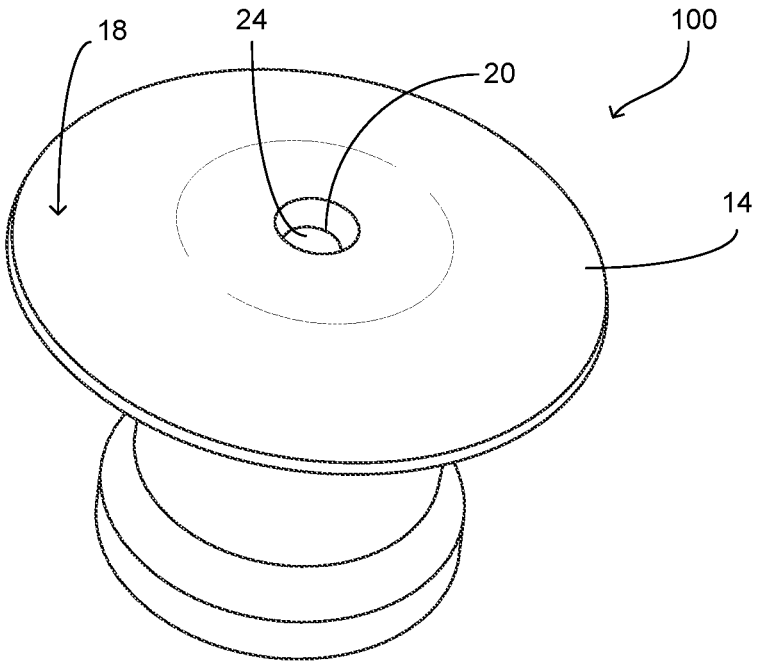
FIG. 1 is a top perspective view of the present invention.
Figure 2:
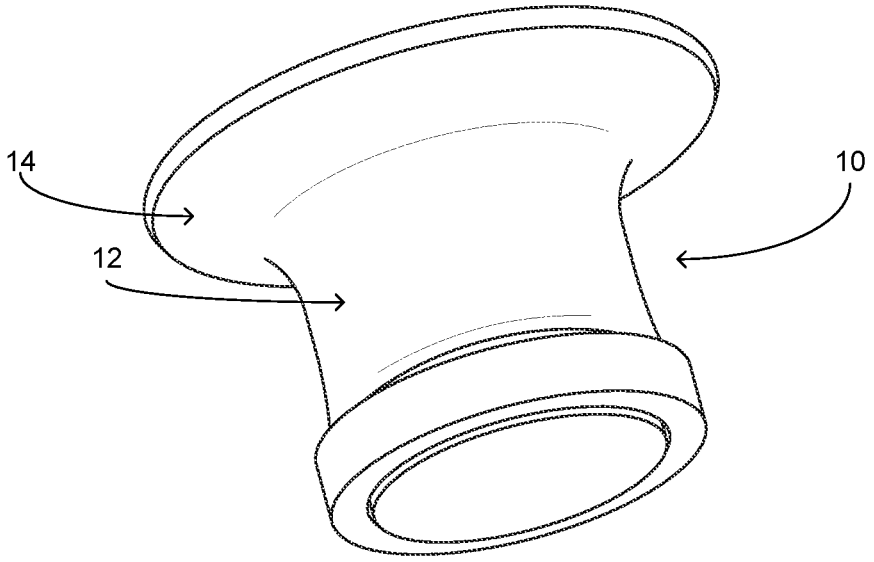
FIG. 2 is a bottom perspective view of the present invention.
Figure 3:
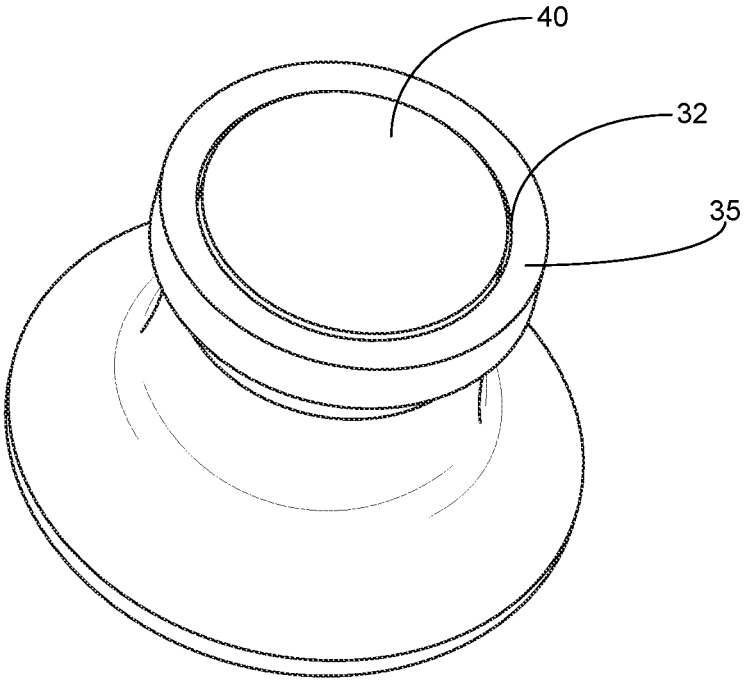
FIG. 3 is a bottom view of the present invention.
Figure 4:
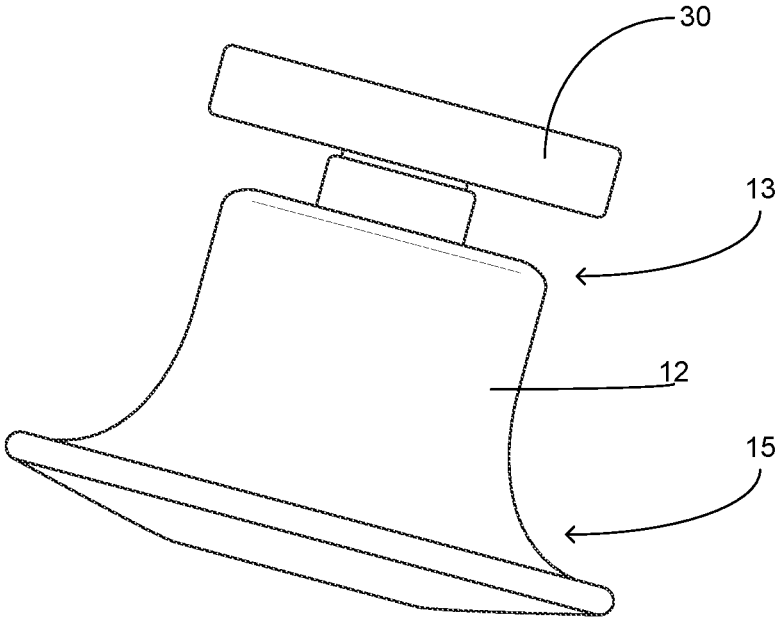
FIG. 4 is a side view of the present invention.

Referring now to the drawings submitted herewith, wherein various elements depicted therein are not necessarily drawn to scale and wherein through the views and figures like elements are referenced with identical reference numerals, there is illustrated pin attachment device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the pin attachment device 100 includes a body 10. The body 10 is manufactured from a rigid material such as but not limited to metal. The body 10 includes a lower portion 12 and an upper portion 14. The lower portion 12 and upper portion 14 are contiguously formed. The lower portion 12 of the body 10 is cylindrical in shape having a first end 13 and a second end 15. The second end 15 is flared outward in form at a transition area of the body 10 to the upper portion 14. The upper portion 14 is annular in shape and has a diameter that is greater than that of the lower portion 12. The upper portion 14 includes an exterior surface 18 wherein the exterior surface 18 has formed therein an aperture 20. While the upper portion 14 is illustrated herein as having a diameter greater than that of the lower portion 12, it is contemplated within the scope of the present invention that the upper portion 14 and lower portion 12 could have equivalent diameters.

The aperture 20 is annular in shape and provides access to the pin stud receiving passage 24. The pin stud receiving passage 24 extends downward into the body 10 particularly into the lower portion 12 thereof. The aperture 20 and pin stud receiving passage 24 are manufactured of suitable size to receive therein a pin stud found on the back of a conventional decorative pin. In use to secure a decorative pin to a first material, clothing, the pin stud of the decorative pin is journaled through a portion of clothing and the body 10 is placed so as to receive the pin stud into the aperture 20 and pin stud receiving passage 24 on the opposing side of the clothing.

Movably coupled to the first end 13 of the lower portion 12 is the locking member 30. The locking member 30 is movable between a first position and a second position and is configured to releasably secure a pin stud ensuing placement thereof into the pin stud receiving passage 24. The locking member 30 is annular in shape and planar in manner. Formed on the lower surface of the locking member 30 is a cavity 32. The cavity 32 is annular in shape and is circumferentially surrounded by a perimeter wall 35. The perimeter wall 35 is operable to maintain the securing member 40 within the cavity 32. The cavity 32 is formed so as to have mounted therein the securing member 40. The securing member 40 is mounted into the cavity 32 utilizing suitable techniques such as but not limited to chemical adhesion. The securing member 40 provides the ability to mount a decorative pin to a second material wherein the second material is not clothing. In a preferred embodiment the securing member 40 is a magnet and as such a decorative pin can be operably coupled to the pin attachment device 100 and the securing member 40 can be utilized to display the decorative pin on a surface to which the magnet securing member 40 can be secured. It is further contemplated within the scope of the present invention that the securing member 40 could be manufactured from alternate materials so as to facilitate the mounting of the pin attachment device 100 to a second material. By way of example but not limitation, the securing member 40 could be manufactured from hook and loop material.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A pin attachment device that is configured to secure a decorative pin to either of a first material and a second material, the first material and the second material being different materials, wherein the pin attachment device comprises:

a body, said body having a lower portion and an upper portion, said lower portion and said upper portion of said body being contiguously formed, said upper portion having an upper surface;

an aperture, said aperture being formed in said upper surface of said upper portion of said body, said aperture providing access to a pin stud receiving passage, said pin stud receiving passage extending into said body, said pin stud receiving passage operable to coupled to a pin stud of a decorative pin and to secure the decorative pin to the first material when the pin stud is pushed through the first material and coupled within the pin stud receiving passage;

a locking member, said locking member being operably coupled to said lower portion of said body distal to said upper portion, said locking member movable between a first position wherein the pin stud is coupled within the pin stud receiving passage and a second position wherein the pin stud is not coupled within the pin stud receiving passage, said locking member having a lower surface opposite said lower portion of said body, said locking member having a cavity formed in the lower surface; and a securing member, said securing member being disposed in said cavity of said locking member, said securing member configured to secure the pin attachment device to the second material via surface contact of the securing member with the second material.

2. The pin attachment device as recited in claim 1, and further including a perimeter wall, said perimeter wall being formed on the lower surface of the locking member, said perimeter wall circumferentially disposed around said cavity, the perimeter wall surrounding the securing member.

3. The pin attachment device as recited in claim 2, wherein said upper portion of said body has a diameter that is greater than said lower portion.

4. The pin attachment device as recited in claim 3, wherein said securing member is a magnet and operable to releasably secure the pin attachment device to the second material.

5. The pin attachment device as recited in claim 4, wherein the second material is a magnetic material.

6. The pin attachment device as recited in claim 5, wherein the first material is a piece of clothing.

* * * * *